US006278380B1

(12) United States Patent
Minamisawa et al.

(10) Patent No.: US 6,278,380 B1
(45) Date of Patent: Aug. 21, 2001

(54) METHOD AND APPARATUS FOR SENSING VEHICLE

(75) Inventors: Shinichi Minamisawa; Yoshinobu Saitoh, both of Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/285,652

(22) Filed: Apr. 5, 1999

(30) Foreign Application Priority Data

Apr. 8, 1998 (JP) ..... 10-111396

(51) Int. Cl.[7] ..... G08G 1/01
(52) U.S. Cl. ..... 340/941; 340/933; 324/226
(58) Field of Search ..... 340/941, 933; 324/202, 226, 225, 235, 236

(56) References Cited

U.S. PATENT DOCUMENTS 4,566,008 * 1/1986 Powers et al. ..... 340/941

* cited by examiner

*Primary Examiner*—Daryl Pope
(74) *Attorney, Agent, or Firm*—Louis Woo

(57) ABSTRACT

First and second loop coils are located at respective positions separate from each other by a predetermined distance. A first electric signal is generated which depends on an inductance of the first loop coil. A second electric signal is generated which depends on an inductance of the second loop coil. Detection is made as to a speed of a vehicle, which passes through first and second given regions determined by the respective positions of the first and second loop coils, in response to the first and second electric signals. The first electric signal is compared with a reference signal to decide whether or not a vehicle passes through the first given region determined by the position of the first loop coil. The reference signal is controlled in response to conditions of the first electric signal which occur in a follow-up time. The follow-up time is changed in response to the detected vehicle speed.

11 Claims, 11 Drawing Sheets

METHOD AND APPARATUS FOR SENSING VEHICLE

BACKGROUND OF THE INVENTION

1. Field of the Invention

This invention relates to a method of sensing a vehicle which uses a sensing loop coil. Also, this invention relates to an apparatus for sensing a vehicle which uses a sensing loop coil.

2. Description of the Related Art

Some vehicle sensing apparatuses include a loop coil provided on a road or buried in the ground under a road. The loop coil forms a part of a resonance circuit in an oscillation circuit. Thus, the inductance of the loop coil determines the frequency of the output signal of the oscillation circuit. When a vehicle passes through a given region or a sensing area near the loop coil, the inductance of the loop coil varies and the frequency of the output signal of the oscillation circuit also varies. Such a variation in the output signal of the oscillation circuit is detected as an indication that a vehicle passes through the sensing area (the given region).

A prior-art vehicle sensing apparatus having a loop coil detects the deviation $\Delta f$ of the frequency of the output signal of an oscillation circuit from a reference frequency. When the frequency deviation $\Delta f$ exceeds a first threshold value, it is decided that a vehicle passes through a sensing area. The inductance of the loop coil, that is, the frequency of the output signal of the oscillation circuit, tends to vary in response to an environmental change such as a change in atmospheric temperature or a start of rain. In view of this fact, the prior-art vehicle sensing apparatus implements adaptive control of the reference frequency. Specifically, there is set a second threshold value smaller than the first threshold value. An allowable range for the frequency deviation $\Delta f$ is provided in connection with the second threshold value. In the case where the frequency deviation $\Delta f$ moves out of the allowable range, a decision is made as to whether or not the frequency deviation $\Delta f$ exceeds the second threshold value during a given time interval t0 from its movement out of the allowable range. If it is decided that the frequency deviation $\Delta f$ does not exceed the second threshold value until the end of the given time interval t0, the reference frequency is corrected. The given time interval t0 is referred to as a follow-up time for an environmental change. Generally, the follow-up time is set to 1 second.

The prior-art vehicle sensing apparatus has a problem as follows. Vehicles in a traffic jam tend to slowly pass through the sensing area. In some of these cases, the frequency deviation $\Delta f$ remains lower than the second threshold value for longer than the follow-up time so that the reference frequency is corrected. This correction of the reference frequency is caused by the traffic jam rather than an environmental change to be considered.

SUMMARY OF THE INVENTION

It is a first object of this invention to provide a method of sensing a vehicle which is less affected by a traffic jam.

It is a second object of this invention to provide an apparatus for sensing a vehicle which is less affected by a traffic jam.

A first aspect of this invention provides a method of sensing a vehicle which comprises the steps of placing first and second loop coils at respective positions separate from each other by a predetermined distance; generating a first electric signal depending on an inductance of the first loop coil; generating a second electric signal depending on an inductance of the second loop coil; detecting a speed of a vehicle, which passes through first and second given regions determined by the respective positions of the first and second loop coils, in response to the first and second electric signals; comparing the first electric signal with a reference signal to decide whether or not a vehicle passes through the first given region determined by the position of the first loop coil; controlling the reference signal in response to conditions of the first electric signal which occur in a follow-up time; and changing the follow-up time in response to the detected vehicle speed.

A second aspect of this invention is based on the first aspect thereof, and provides a method wherein the changing step comprises increasing the follow-up time as the detected vehicle speed decreases.

A third aspect of this invention provides a method of sensing a vehicle which comprises the steps of placing first and second loop coils at respective positions separate from each other by a predetermined distance; generating a first electric signal depending on an inductance of the first loop coil; generating a second electric signal depending on an inductance of the second loop coil; comparing the first electric signal with a reference signal to decide whether or not a vehicle passes through a given region determined by the position of the first loop coil; controlling the reference signal in response to the first electric signal; deciding whether or not the first and second electric signals correlate with each other; permitting the control of the reference signal when it is decided that the first and second electric signals correlate with each other; and inhibiting the control of the reference signal when it is decided that the first and second electric signals do not correlate with each other.

A fourth aspect of this invention provides a method of sensing a vehicle which uses a loop coil. The method comprises the steps of generating an electric signal depending on an inductance of the loop coil; comparing the electric signal with a reference signal to decide whether or not the electric signal is in a range determined by the reference signal, wherein the electric signal being in the range represents that a vehicle passes through a given region determined by a position of the loop coil, and the electric signal being not in the range represents that a vehicle does not pass through the given region determined by the position of the loop coil; and changing the reference signal in cases where the electric signal continues to be in the range for a predetermined time.

A fifth aspect of this invention provides an apparatus for sensing a vehicle which comprises first and second loop coils located at respective positions separate from each other by a predetermined distance; means for generating a first electric signal depending on an inductance of the first loop coil; means for generating a second electric signal depending on an inductance of the second loop coil; means for detecting a speed of a vehicle, which passes through first and second given regions determined by the respective positions of the first and second loop coils, in response to the first and second electric signals; means for comparing the first electric signal with a reference signal to decide whether or not a vehicle passes through the first given region determined by the position of the first loop coil; means for controlling the reference signal in response to conditions of the first electric signal which occur in a follow-up time; and means for changing the follow-up time in response to the detected vehicle speed.

A sixth aspect of this invention is based on the fifth aspect thereof, and provides an apparatus wherein the changing means comprises means for increasing the follow-up time as the detected vehicle speed decreases.

A seventh aspect of this invention provides an apparatus for sensing a vehicle which comprises first and second loop coils located at respective positions separate from each other by a predetermined distance; means for generating a first electric signal depending on an inductance of the first loop coil; means for generating a second electric signal depending on an inductance of the second loop coil; means for comparing the first electric signal with a reference signal to decide whether or not a vehicle passes through a given region determined by the position of the first loop coil; means for controlling the reference signal in response to the first electric signal; means for deciding whether or not the first and second electric signals correlate with each other; means for permitting the control of the reference signal when it is decided that the first and second electric signals correlate with each other; and means for inhibiting the control of the reference signal when it is decided that the first and second electric signals do not correlate with each other.

An eighth aspect of this invention provides an apparatus for sensing a vehicle which comprises a loop coil; means for generating an electric signal depending on an inductance of the loop coil; means for comparing the electric signal with a reference signal to decide whether or not the electric signal is in a range determined by the reference signal, wherein the electric signal being in the range represents that a vehicle passes through a given region determined by a position of the loop coil, and the electric signal being not in the range represents that a vehicle does not pass through the given region determined by the position of the loop coil; and means for changing the reference signal in cases where the electric signal continues to be in the range for a predetermined time.

A ninth aspect of this invention provides an apparatus for sensing a vehicle which comprises first and second loop coils; a first oscillation circuit including a resonance circuit, a part of which is formed by the first loop coil; a second oscillation circuit including a resonance circuit, a part of which is formed by the second loop coil; a first frequency counter for detecting a frequency of an output signal of the first oscillation circuit; a second frequency counter for detecting a frequency of an output signal of the second oscillation circuit; means for calculating a deviation of at least one of the detected frequencies from a reference frequency; means for detecting whether or not a vehicle passes through a given region, which is determined by related one of the first and second loop coils, in response to the calculated deviation; and means for correcting the reference frequency in cases where after the calculated deviation increases to a first value, the calculated deviation remains between the first value and a second value for a follow-up time, the second value being greater than the first value.

A tenth aspect of this invention is based on the ninth aspect thereof, and provides an apparatus further comprising means for detecting a speed of a vehicle, which passes through first and second given regions determined by positions of the first and second loop coils, in response to output signals of the first and second frequency counters; and means for changing the follow-up time in response to the detected vehicle speed.

An eleventh aspect of this invention is based on the ninth aspect thereof, and provides an apparatus further comprising means for deciding whether or not output signals of the first and second frequency counters correlate with each other; means for permitting the correction of the reference frequency when it is decided that the output signals of the first and second frequency counters correlate with each other; and means for inhibiting the correction of the reference frequency when it is decided that the output signal of the first and second frequency counters do not correlate with each other.

DESCRIPTION OF THE PREFERRED EMBODIMENTS

First Embodiment

Figure 1:
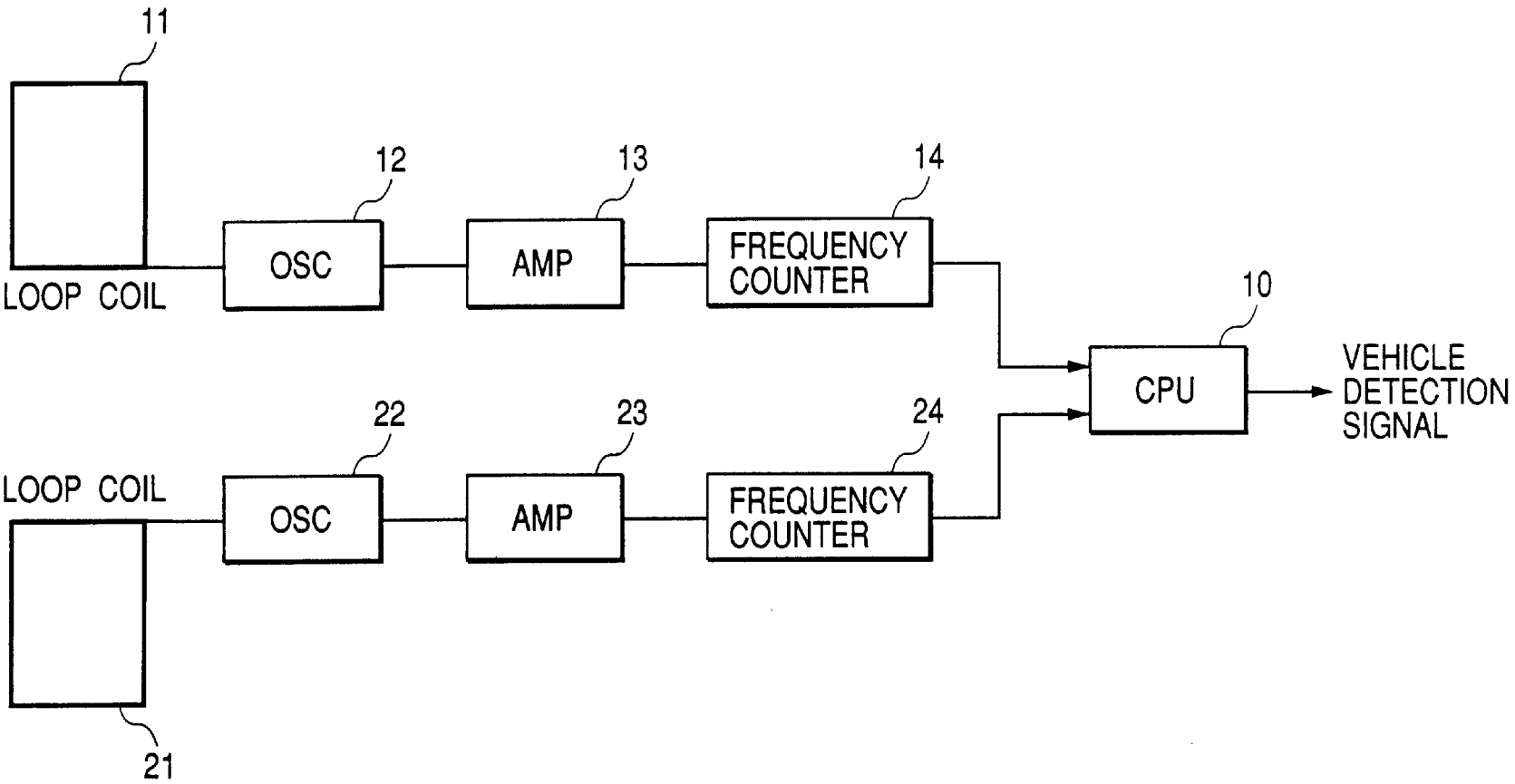
FIG. 1 is a block diagram of a vehicle sensing apparatus according to a first embodiment of this invention.

FIG. 1 shows a vehicle sensing apparatus according to a first embodiment of this invention. The vehicle sensing apparatus of FIG. 1 includes two loop coils (sensing loop coils) 11 and 21. The loop coil 11 forms a part of a resonance circuit in an oscillation circuit 12. The oscillation circuit 12 outputs a signal whose frequency is equal to the natural frequency (the resonance frequency) of the resonance circuit therein. The loop coil 21 forms a part of a resonance circuit in an oscillation circuit 22. The oscillation circuit 22 outputs a signal whose frequency is equal to the natural frequency (the resonance frequency) of the resonance circuit therein.

The oscillation circuit 12 is successively followed by an amplifier circuit (or a buffer circuit) 13 and a frequency counter 14. The frequency counter 14 is connected to a CPU 10. The output signal of the oscillation circuit 12 is fed to the frequency counter 14 via the amplifier circuit 13. The frequency counter 14 measures the frequency of the output signal of the amplifier circuit 13, that is, the frequency of the output signal of the oscillation circuit 12. The frequency counter 14 outputs a signal to the CPU 10 which represents the frequency of the output signal of the oscillation circuit 12.

The oscillation circuit 22 is successively followed by an amplifier circuit (or a buffer circuit) 23 and a frequency counter 24. The frequency counter 24 is connected to the CPU 10. The output signal of the oscillation circuit 22 is fed to the frequency counter 24 via the amplifier circuit 23. The frequency counter 24 measures the frequency of the output signal of the amplifier circuit 23, that is, the frequency of the output signal of the oscillation circuit 22. The frequency counter 24 outputs a signal to the CPU 10 which represents the frequency of the output signal of the oscillation circuit 22.

The CPU 10 includes a combination of an input/output section, a processing section, a ROM, and a RAM. The CPU 10 operates in accordance with a control program stored in the ROM.

According to the control program, the CPU 10 detects or decides, on the basis of the output signal of the frequency counter 14, whether or not a vehicle passes through a given region determined by the position of the loop coil 11 (that is, a sensing area near the loop coil 11). This detection or decision responds to a first reference frequency REF1 for the output signal of the oscillation circuit 12. The CPU 10 outputs a signal representing whether or not a vehicle passes through the sensing area or the given region.

According to the control program, the CPU 10 detects or decides, on the basis of the output signal of the frequency counter 24, whether or not a vehicle passes through a given region determined by the position of the loop coil 21 (that is, a sensing area near the loop coil 21). This detection or decision responds to a second reference frequency REF2 for the output signal of the oscillation circuit 22. The CPU 10 outputs a signal representing whether or not a vehicle passes through the sensing area or the given region. In general, the second reference frequency REF2 is different from the first reference frequency REF1. The second reference frequency REF2 may be equal to the first reference frequency REF1.

The loop coils 11 and 21 are provided on a road or buried in the ground under a road. The loop coils 11 and 12 are separate from each other by a predetermined distance in the longitudinal direction of the road. The predetermined distance is equal to, for example, about 5 meters.

The control program has a speed calculation subroutine (a first segment) which is designed to implement the following processes. The CPU 10 derives the present frequencies of the output signals of the oscillation circuits 12 and 22 from the output signals of the frequency counters 14 and 24. The CPU 10 calculates the deviation (the error) Δf1 of the present frequency of the output signal of the oscillation circuit 12 from the first reference frequency REF1. Also, the CPU 10 calculates the deviation (the error) Δf2 of the present frequency of the output signal of the oscillation circuit 22 from the second reference frequency REF2. The CPU 10 decides whether or not the frequency deviation Δf1 exceeds a first predetermined threshold value SEN1. The CPU 10 detects a moment T1 at which the frequency deviation Δf1 exceeds the first predetermined threshold value SEN1. In addition, the CPU 10 decides whether or not the frequency deviation Δf2 exceeds the first predetermined threshold value SEN1. The CPU 10 detects a moment T2 at which the frequency deviation Δf2 exceeds the first predetermined threshold value SEN1. The CPU 10 calculates the time interval between the moments T1 and T2. The CPU 10 is previously loaded with information of the distance between the loop coils 11 and 21. The CPU 10 calculates the speed of a vehicle from the time interval between the moments T1 and T2 and the distance between the loop coils 11 and 21. The speed calculation is executed for each vehicle which passes through the given regions (the sensing areas) determined by the positions of the loop coils 11 and 21. The speed calculation subroutine (the first segment) of the control program is periodically executed by, for example, a timer-based interruption process.

Figure 2:
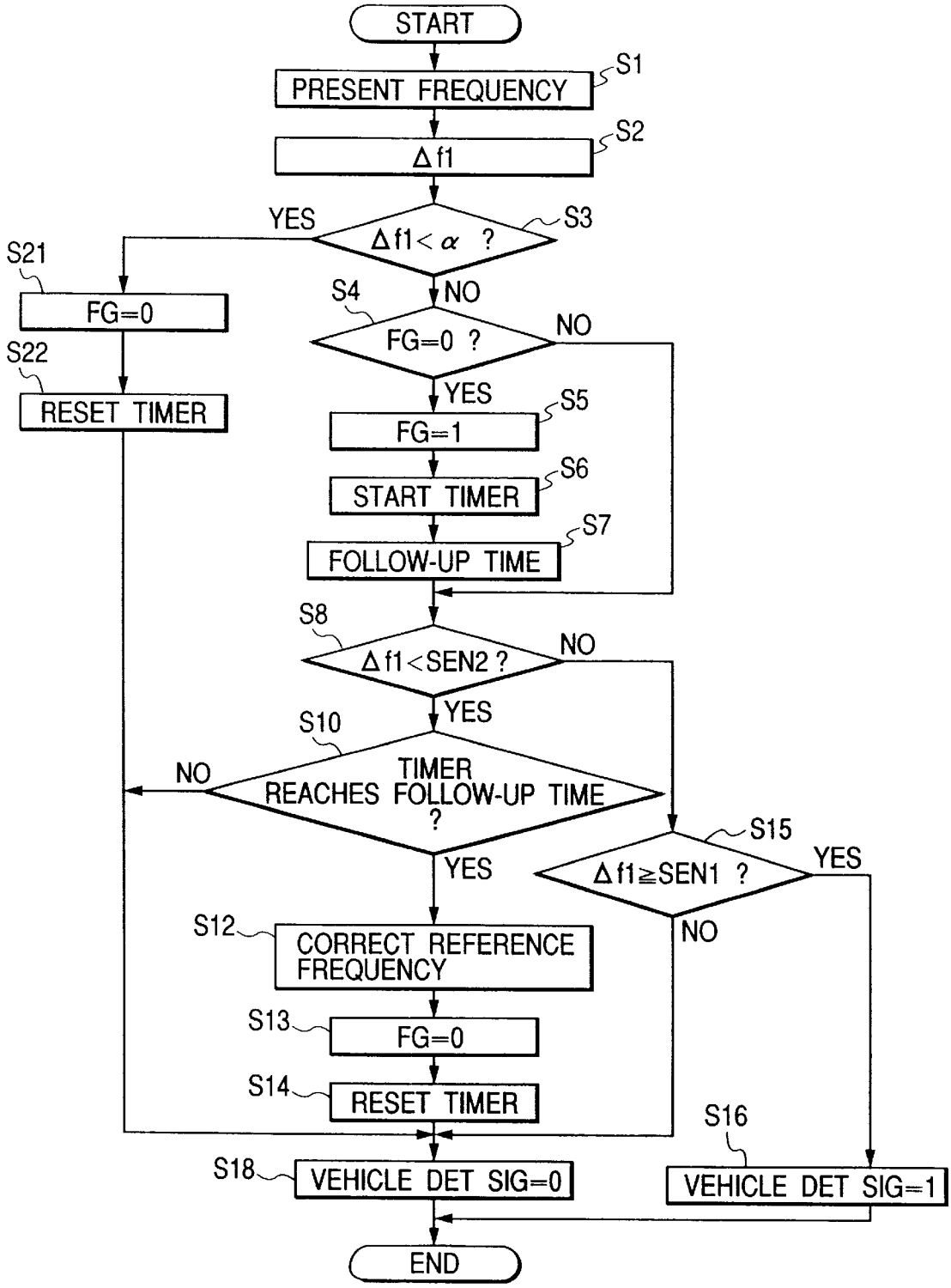
FIG. 2 is a flowchart of a segment of a control program for a CPU in FIG. 1.

FIG. 2 is a flowchart of a second segment of the control program which is designed to adaptively control the first reference frequency REF1 in response to an environmental change, and also to detect whether or not a vehicle passes through the given region (the sensing area) determined by the position of the loop coil 11. The second segment of the control program is periodically executed by, for example, a timer-based interruption process.

As shown in FIG. 2, a first step S1 of the second program segment derives the present frequency of the output signal of the oscillation circuit 12 from the output signal of the frequency counter 14.

A step S2 following the step S1 calculates the deviation (the error) Δf1 of the present frequency of the output signal of the oscillation circuit 12 from a first reference frequency REF1. The frequency deviation Δf1 is equal to the absolute value of the difference between the present frequency of the output signal of the oscillation circuit 12 and the first reference frequency REF1. Prior to the first execution cycle of the second segment of the control program, an initial value of the first reference frequency REF1 has already been given by a main segment (a main routine) of the control program which is executed immediately after the power supply of the vehicle sensing apparatus is turned on.

A step S3 subsequent to the step S2 compares the frequency deviation (the frequency error) Δf1 with a given value "α". The given value "α" defines an allowable range of the frequency deviation Δf1 for noncorrection of the first reference frequency REF1. When the frequency deviation Δf1 is equal to or greater than the given value "α", the program advances from the step S3 to a step S4. Otherwise, the program advances from the step S3 to a step S21.

The step S4 decides whether or not a flag FG is "0". Prior to the first execution cycle of the second segment of the control program, the flag FG is initialized to "0" by the main segment (the main routine) of the control program. When the flag FG is decided to be "0", the program advances from the step S4 to a step S5. Otherwise, the program jumps from the step S4 to a step S8.

The step S5 sets the flag FG to "1". A step S6 following the step S5 starts a timer. The timer measures a lapse of time from every moment at which the frequency deviation Δf1 becomes equal to or greater than the given value "α".

A step S7 following the step S6 retrieves information of the latest vehicle speed which has been calculated by the first segment of the control program. The step S7 compares the latest vehicle speed with a predetermined reference speed. When the latest vehicle speed is higher than the reference speed, the step S7 sets a follow-up time to a first predetermined time t1. When the latest vehicle speed is equal to or lower than the reference speed, the step S7 sets the follow-up time to a second predetermined time t2. The second predetermined time t2 is longer than the first predetermined time t1. After the step S7, the program advances to the step S8.

The step S8 compares the frequency deviation (the frequency error) Δf1 with a second predetermined threshold value SEN2. The second predetermined threshold value SEN2 is greater than the given value "α" and smaller than the first predetermined threshold value SEN1. When the frequency deviation Δf1 is smaller than the second predetermined threshold value SEN2, the program advances from the step S8 to a step S10. Otherwise, the program advances from the step S8 to a step S15.

The step S10 accesses the timer, and derives the lapse of time which is measured by the timer. The step S10 decides whether or not the lapse of time reaches the follow-up time. When the lapse of time reaches the follow-up time, the program advances from the step S10 to a step S12. Otherwise, the program jumps from the step S10 to a step S18.

The step S12 corrects the first reference frequency REF1 to reduce or nullify the frequency deviation Δf1. Therefore, in the case where the frequency deviation Δf1 continues to be between the given value "α" and the second predetermined threshold value SEN2 for the follow-up time or longer, the first reference frequency REF1 is corrected.

A step S13 following the step S21 sets the flag FG to "0". A step S14 following the step S13 resets or clears the timer. After the step S14, the program advances to the step S18.

The step S18 sets a vehicle detection signal to a state of "0" which represents that a vehicle does not pass through the given region (the sensing area) determined by the position of the loop coil 11. The step S18 outputs the vehicle detection signal being "0". After the step S18, the current execution cycle of the second program segment ends.

The step S15 compares the frequency deviation (the frequency error) Δf1 with the first predetermined threshold value SEN1. When the frequency deviation Δf1 is equal to or greater than the first predetermined threshold value SEN1, the program advances from the step S15 to a step S16. Otherwise, the program advances from the step S15 to the step S18.

The step S16 sets the vehicle detection signal to a state of "1" which represents that a vehicle passes through the given region (the sensing area) determined by the position of the loop coil 11. The step S16 outputs the vehicle detection signal being "1". After the step S16, the current execution cycle of the second program segment ends.

The step S21 sets the flag FG to "0". A step S22 following the step S21 resets or clears the timer. After the step S22, the program advances to the step S18.

Regarding the program segment in FIG. 2, the vehicle sensing apparatus operates as follows. In the case where the frequency deviation Δf1 remains smaller than the given value "α", the first reference frequency REF1 continues to be unchanged. On the other hand, in the case where the frequency deviation Δf1 remains between the given value "α" and the second predetermined threshold value SEN2 for the follow-up time or longer, the first reference frequency REF1 is corrected. In this case, the correction of the first reference frequency REF1 is iterated at a period corresponding to the follow-up time. The follow-up time depends on the latest calculated vehicle speed. Specifically, the follow-up time is equal to the shorter time t1 when the latest vehicle speed is higher than the reference speed. The follow-up time is equal to the longer time t2 when the latest vehicle speed is equal to or lower than the reference speed. Accordingly, when the latest vehicle speed is relatively high, the correction of the first reference frequency REF1 can be implemented at a higher pace. On the other hand, when the latest vehicle speed is relatively low, the correction of the first reference frequency REF1 can be implemented at a lower pace. This process can prevent the first reference frequency REF1 from being erroneously corrected due to a traffic jam. When the frequency deviation Δf1 is equal to or greater than the first predetermined threshold value SEN1, the output vehicle detection signal is in a state of "1" which represents that a vehicle passes through the given region (the sensing area) determined by the position of the loop coil 11. Otherwise, the output vehicle detection signal is in a state of "0" which represents that a vehicle does not pass through the given region (the sensing area).

Figure 3:
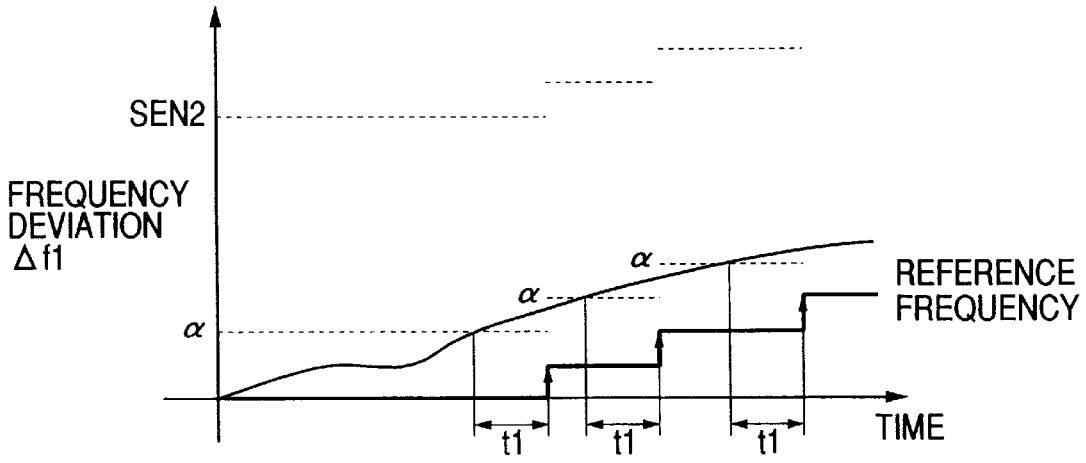
FIG. 3 is a time-domain diagram of a frequency deviation and a reference frequency which occur under first conditions in the vehicle sensing apparatus of FIG. 1.

FIG. 3 shows conditions where the latest vehicle speed is relatively high so that the follow-up time is equal to the shorter time t1. In addition, the frequency deviation Δf1 remains lower than the second predetermined threshold value SEN2. Under the conditions in FIG. 3, each time the lapse of time from the moment of an increase of the frequency deviation Δf1 to the given value "α" reaches the follow-up time t1, the first reference frequency REF1 is corrected to reduce or nullify the frequency deviation Δf1.

Figure 4:
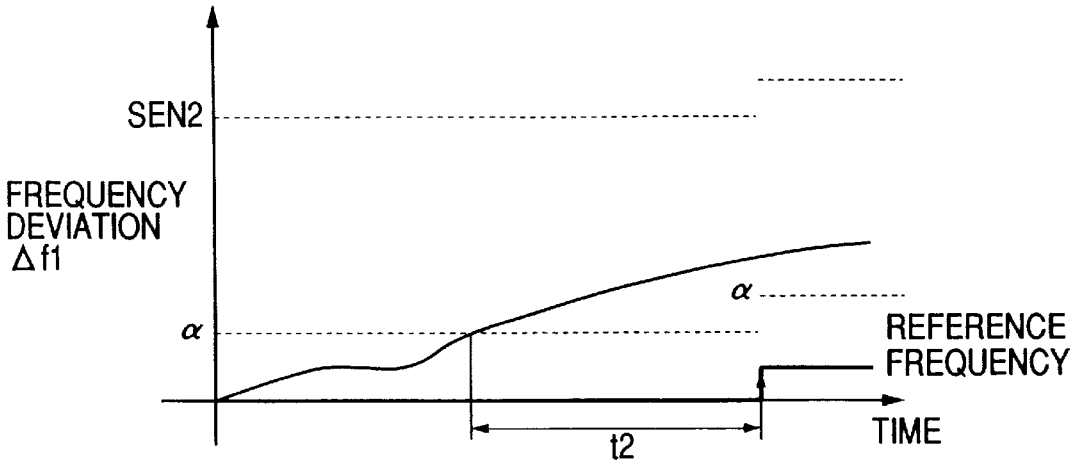
FIG. 4 is a time-domain diagram of the frequency deviation and the reference frequency which occur under second conditions in the vehicle sensing apparatus of FIG. 1.

FIG. 4 shows conditions where the latest vehicle speed is relatively low so that the follow-up time is equal to the longer time t2. In addition, the frequency deviation Δf1 remains lower than the second predetermined threshold value SEN2. Under the conditions in FIG. 4, each time the lapse of time from the moment of an increase of the frequency deviation Δf1 to the given value "α" reaches the follow-up time t2, the first reference frequency REF1 is corrected to reduce or nullify the frequency deviation Δf1.

The control program has a third segment which is designed to adaptively control the second reference frequency REF2 in response to an environmental change, and also to detect whether or not a vehicle passes through the given region (the sensing area) determined by the position of the loop coil 21. The third segment of the control program is similar to the second segment thereof. The third segment of the control program is periodically executed by, for example, a timer-based interruption process.

It should be noted that the follow-up time may be changed among three or more different values in response to the latest vehicle speed.

The first reference frequency REF1 may be corrected also in the case where the frequency deviation Δf1 remains between the first and second predetermined threshold values SEN1 and SEN2 for a predetermined time interval or longer.

Second Embodiment

Figure 5:
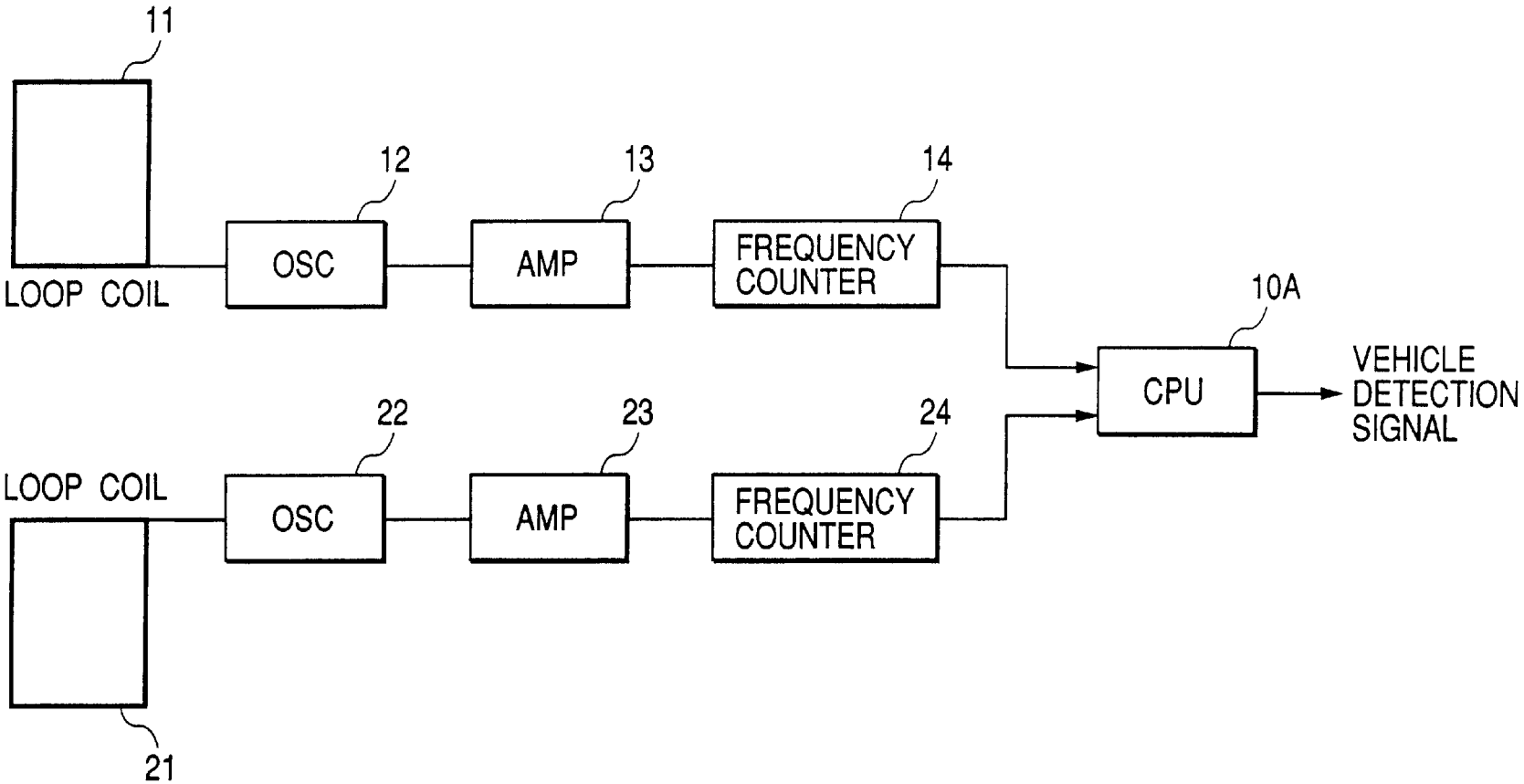
FIG. 5 is a block diagram of a vehicle sensing apparatus according to a second embodiment of this invention.

FIG. 5 shows a second embodiment of this invention which is similar to the embodiment of FIGS. 1–4 except for design changes indicated hereinafter. The embodiment of FIG. 5 includes a CPU 10A instead of the CPU 10 in FIG. 1. In the embodiment of FIG. 5, the position of a loop coil 11 is upstream of the position of a loop coil 21 as viewed in the direction of travel of vehicles.

Figure 6:
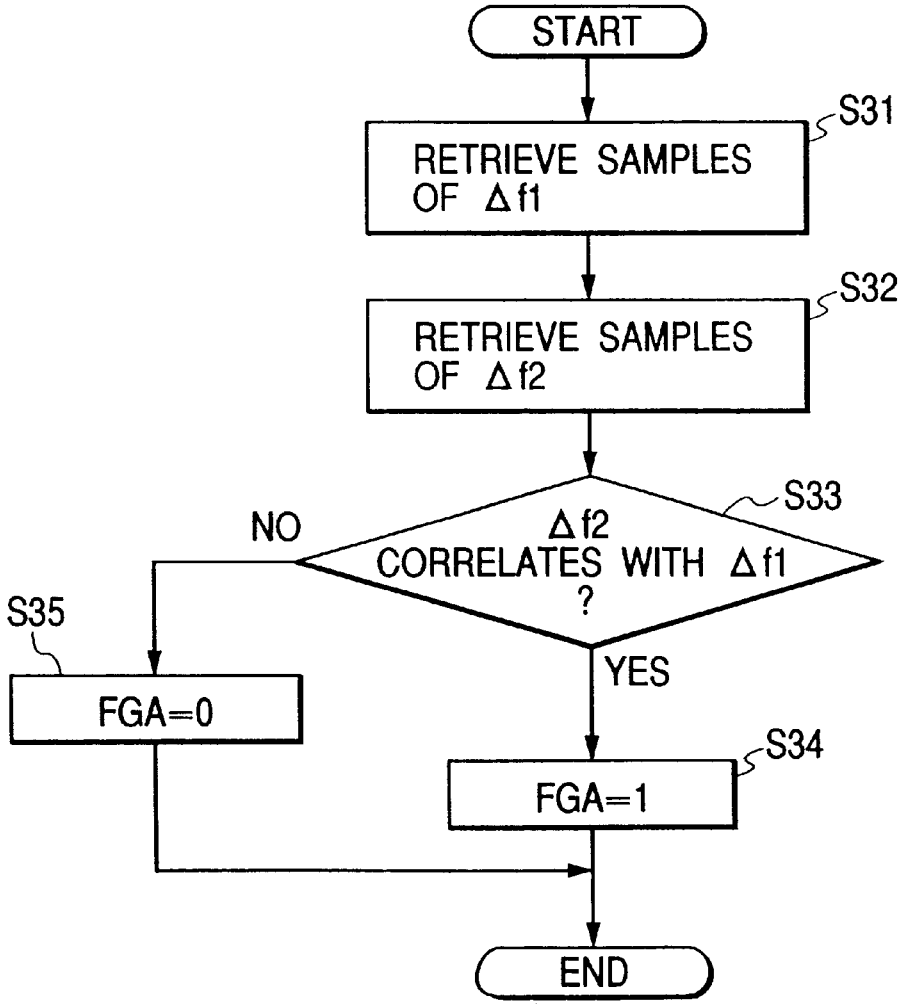
FIG. 6 is a flowchart of a segment of a control program for a CPU in FIG. 5.

FIG. 6 is a flowchart of a segment of a control program in the CPU 10A. The program segment in FIG. 6 is periodically executed by, for example, a timer-based interruption process.

As shown in FIG. 6, a first step S31 of the program segment retrieves a predetermined number of information pieces of the latest and former samples of a frequency deviation Δf1.

A step S32 following the step S31 retrieves a predetermined number of information pieces of the latest and former samples of a frequency deviation Δf2.

A step S33 subsequent to the step S32 decides whether or not the frequency deviation Δf2 correlates with the frequency deviation Δf1 on the basis of the samples thereof. For example, the similarity between the set of the samples of the frequency deviation Δf1 and the set of the samples of the frequency deviation Δf2 is calculated by a pattern matching process. The calculated similarity which equals or exceeds a given threshold value is used as an indication that the frequency deviation Δf2 follows the frequency deviation Δf1 and hence correlates therewith. The calculated similarity less than the given threshold value is used as an indication that the frequency deviation Δf2 does not follow the frequency deviation Δf1 and hence does not correlate therewith. When the frequency deviation Δf2 correlates with the frequency deviation Δf1, the program advances from the step S33 to a step S34. Otherwise, the program advances from the step S33 to a step S35.

The step S34 sets a flag FGA to "1". The flag FGA being "1" represents that the frequency deviation Δf2 correlates with the frequency deviation Δf1. After the step S34, the current execution cycle of the program segment ends.

The step S35 sets the flag FGA to "0". The flag FGA being "0" represents that the frequency deviation Δf2 does not correlate with the frequency deviation Δf1. After the step S35, the current execution cycle of the program segment ends.

Figure 7:
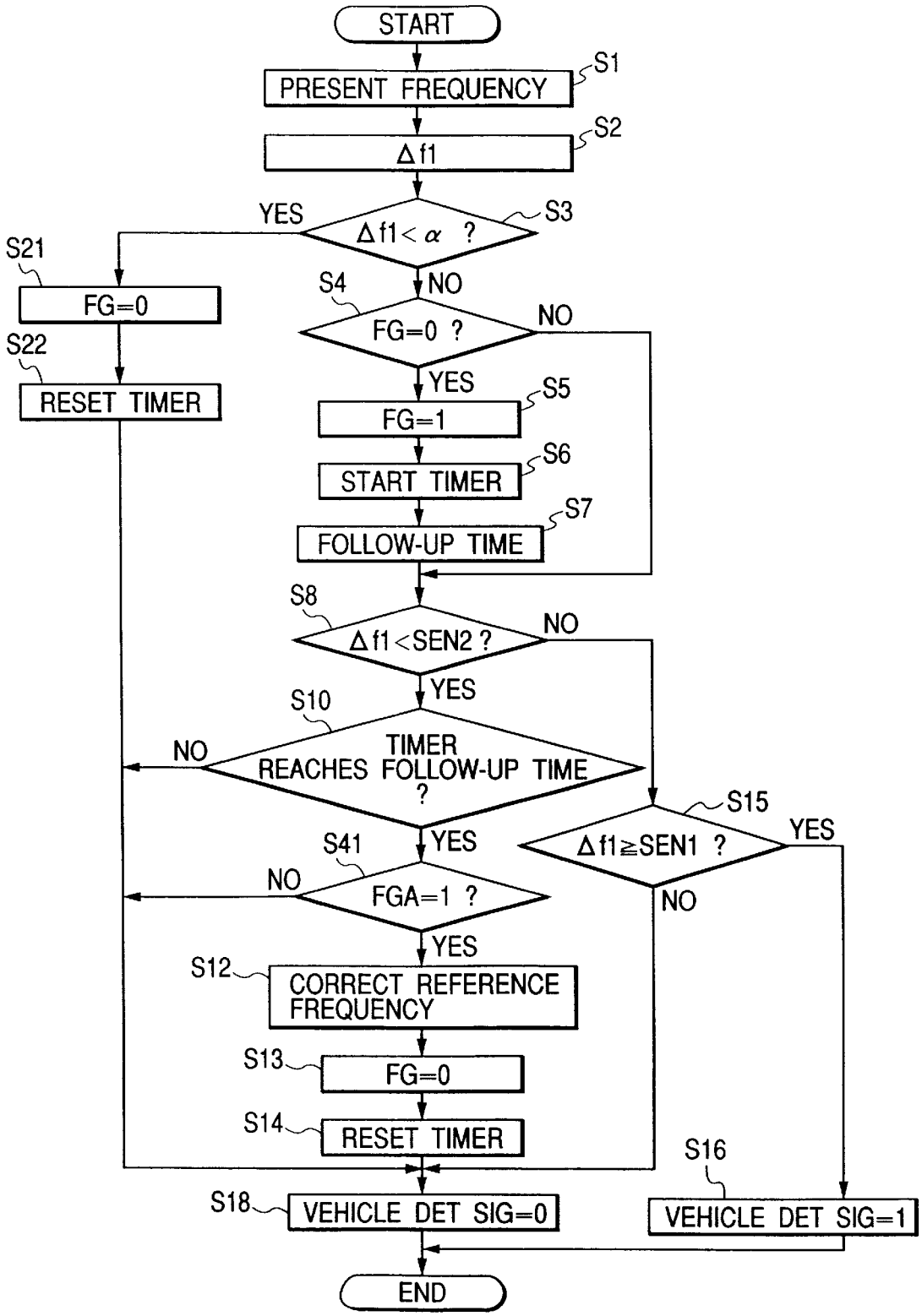
FIG. 7 is a flowchart of another segment of the control program for the CPU in FIG. 5.

FIG. 7 shows another segment of the control program in the CPU 10A which corresponds to the program segment in FIG. 2. The program segment in FIG. 7 has a step S41 located between steps S10 and S12. The step S41 decides whether or not the flag FGA is "1". When the flag FGA is "1", the program advances from the step S41 to the step S12 which corrects a first reference frequency REF1. When the flag FGA is not "1", the program jumps from the step S41 to a step S18. Accordingly, in this case, the first reference frequency REF1 remains unchanged.

As understood from the previous explanation, in the case where the frequency deviation Δf2 correlates with the frequency deviation Δf1, the correction of the first reference frequency REF1 is permitted. In the case where the frequency deviation Δf2 does not correlate with the frequency deviation Δf1, the correction of the first reference frequency REF1 is inhibited.

Similarly, correction of a second reference frequency REF2 is permitted and inhibited in response to whether or not the frequency deviation Δf2 correlates with the frequency deviation Δf1.

Figure 8:
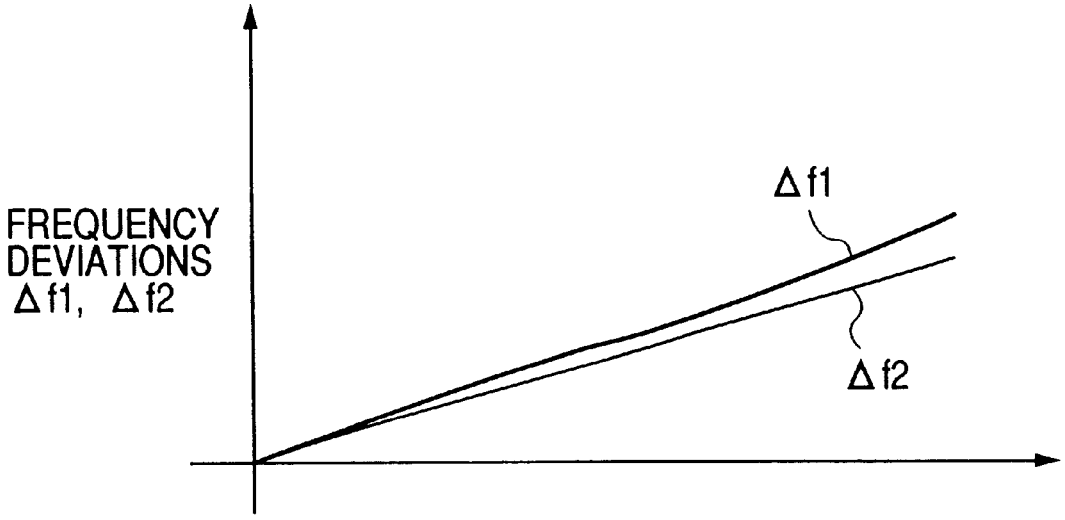
FIG. 8 is a time-domain diagram of frequency deviations which occur under first conditions in the vehicle sensing apparatus of FIG. 5.

FIG. 8 shows an example of conditions where the frequency deviation Δf2 follows the frequency deviation Δf1 and hence correlates therewith.

Figure 9:
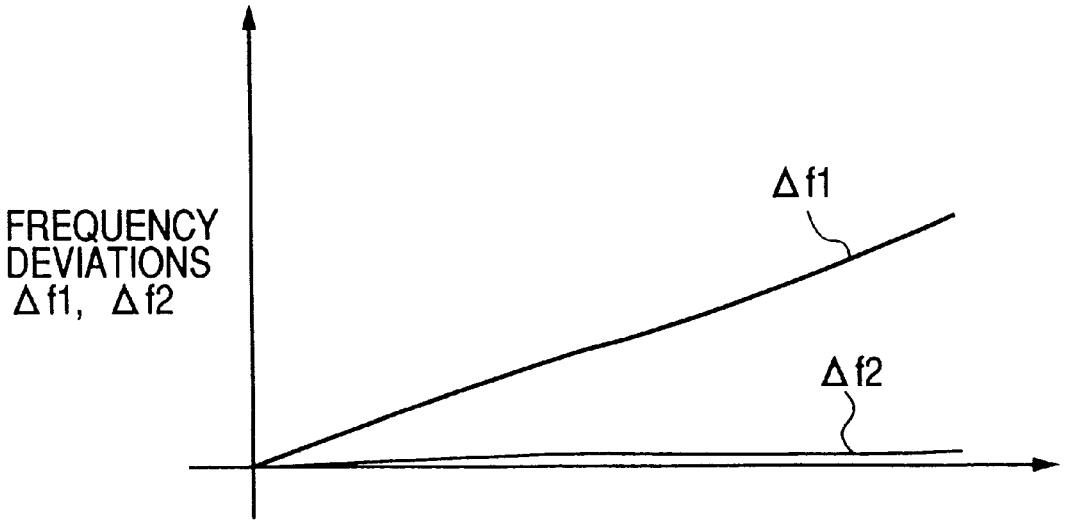
FIG. 9 is a time-domain diagram of the frequency deviations which occur under second conditions in the vehicle sensing apparatus of FIG. 5.

FIG. 9 shows an example of conditions where the frequency deviation Δf2 does not follow the frequency deviation Δf1 and hence does not correlate therewith.

Third Embodiment

Figure 10:
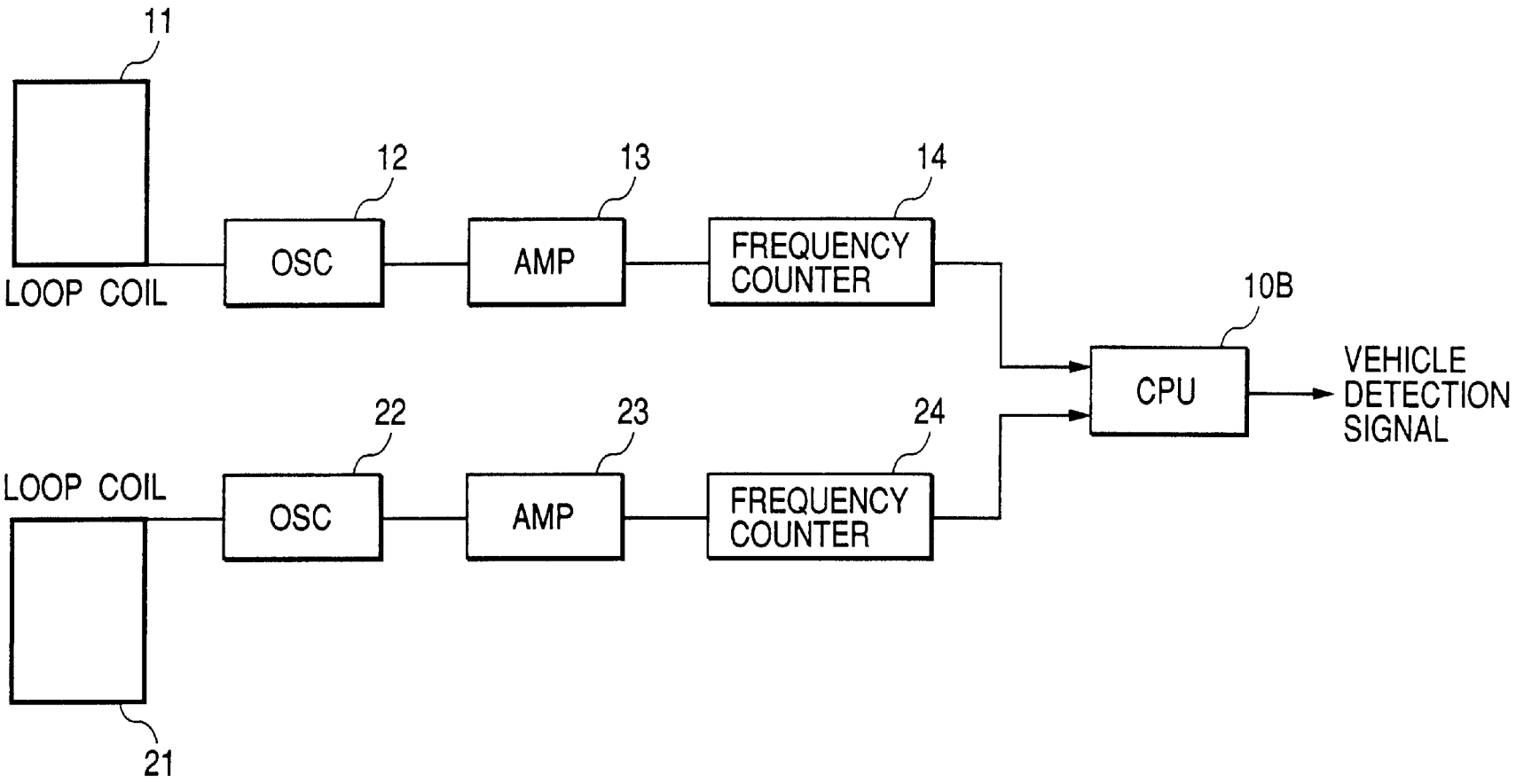
FIG. 10 is a block diagram of a vehicle sensing apparatus according to a third embodiment of this invention.

FIG. 10 shows a third embodiment of this invention which is similar to the embodiment of FIGS. 1–4 except for design changes indicated hereinafter. The embodiment of FIG. 10 includes a CPU 10B instead of the CPU 10 in FIG. 1.

Figure 11:
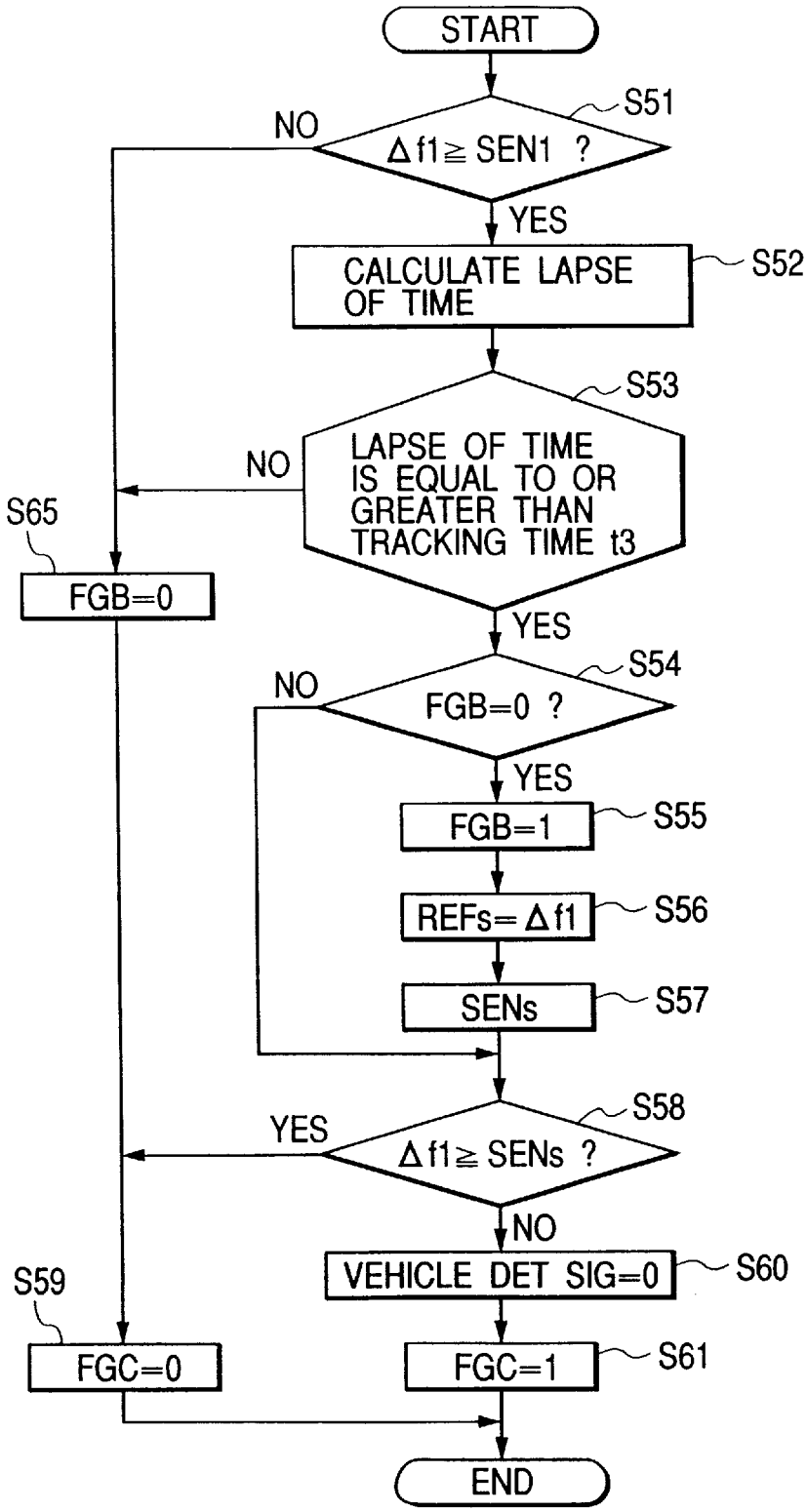
FIG. 11 is a flowchart of a segment of a control program for a CPU in FIG. 10.

FIG. 11 is a flowchart of a segment of a control program in the CPU 10B. The program segment in FIG. 11 is periodically executed by, for example, a timer-based interruption process.

As shown in FIG. 1, a first step S51 of the program segment compares a frequency deviation Δf1 with a first predetermined threshold value SEN1. When the frequency deviation Δf1 is equal to or greater than the first predetermined threshold value SEN1, the program advances from the step S51 to a step S52. Otherwise, the program advances from the step S51 to a step S65.

The step S52 calculates a lapse of time during which the frequency deviation Δf1 continues to be equal to or greater than the first predetermined threshold value SEN1.

A step S53 following the step S52 compares the lapse of time, which is calculated by the step S52, with a predetermined reference time (a predetermined tracking time) t3. When the calculated lapse of time is equal to or longer than the predetermined reference time t3, the program advances from the step S53 to a step S54. Otherwise, the program advances from the step S53 to the step S65.

The step S54 decides whether or not a flag FGB is "0". Prior to the first execution cycle of the program segment in FIG. 11, the flag FGB is initialized to "0" by a main segment (a main routine) of the control program. When the flag FGB is decided to be "0", the program advances from the step S54 to a step S55. Otherwise, the program jumps from the step S54 to a step S58.

The step S55 sets the flag FGB to "1". A step S56 following the step S55 sets a pseudo reference value REFs to the frequency deviation Δf1. Thus, the pseudo reference value REFs is set to the frequency deviation Δf1 occurring when the lapse of time, which is calculated by the step S52, reaches the predetermined reference time (the predetermined tracking time) t3.

A step S57 subsequent to the step S56 calculates a pseudo threshold value SENs from the pseudo reference value REFs. Specifically, the pseudo threshold value SENs is greater than the pseudo reference value REFs by a given value. After the step S57, the program advances to the step S58.

The step S58 compares the frequency deviation Δf1 with the pseudo threshold value SENs. When the frequency deviation Δf1 is equal to or greater than the pseudo threshold value SENs, the program advances from the step S58 to a step S59. Otherwise, the program advances from the step S58 to a step S60.

The step S59 sets a flag FGC to "0". After the step S59, the current execution cycle of the program segment ends.

The step S60 sets a vehicle detection signal to a state of "0"which represents that a vehicle does not pass through a given region (a sensing area) determined by the position of a loop coil 11. The step S60 outputs the vehicle detection signal being "0".

A step S61 following the step S60 sets the flag FGC to "1". After the step S61, the current execution cycle of the program segment ends.

The step S65 sets the flag FGB to "0". After the step S65, the program advances to the step S59.

Figure 12:
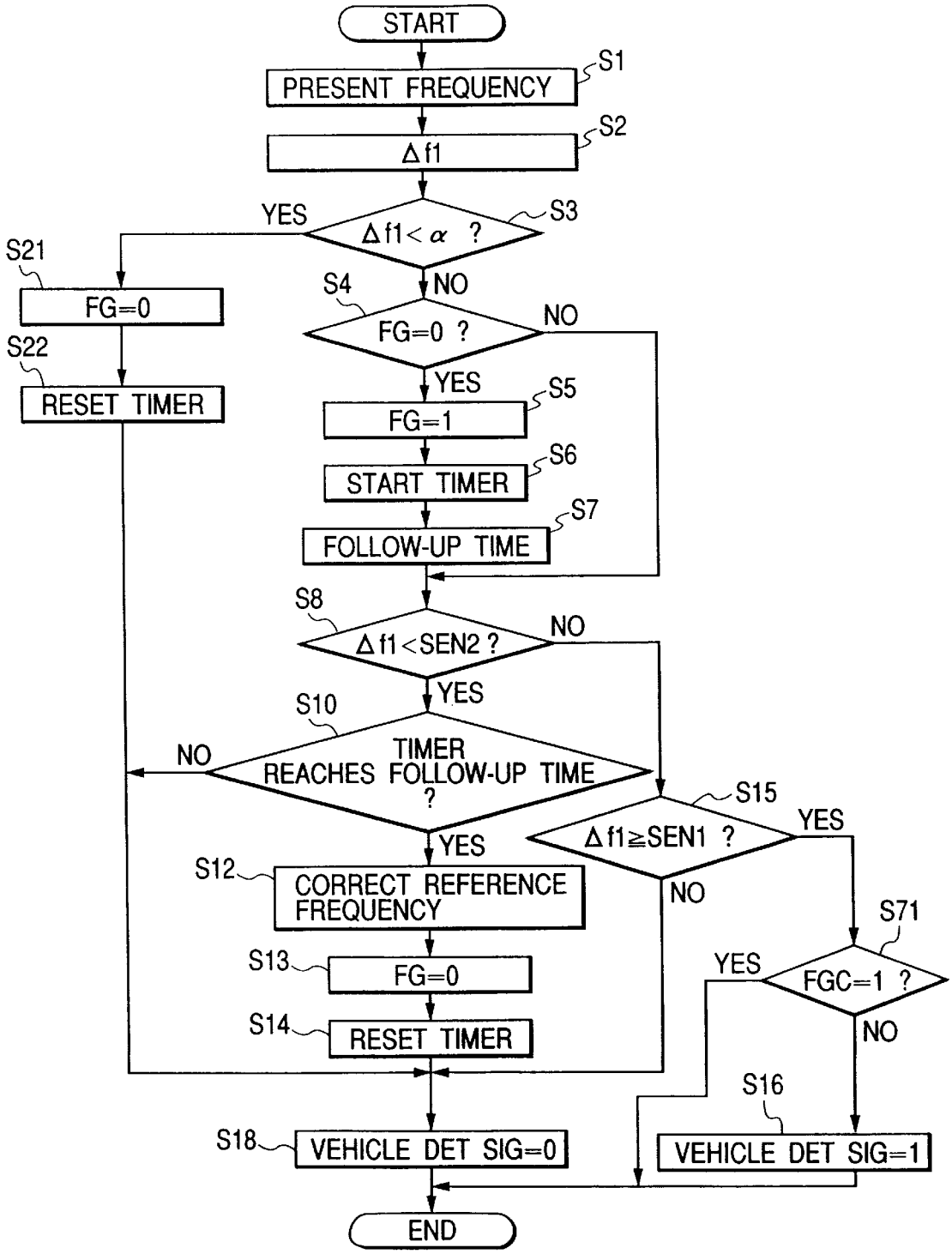
FIG. 12 is a flowchart of another segment of the control program for the CPU in FIG. 10.

FIG. 12 shows another segment of the control program in the CPU 10B which corresponds to the program segment in FIG. 2. The program segment in FIG. 12 has a step S71 located between steps S15 and S16. The step S71 decides whether or not the flag FGC is "1". When the flag FGC is not "1", the program advances from the step S71 to the step S16. When the flag FGC is "1", the program exits from the step S71 and then the current execution cycle of the program segment ends. In this case, the program bypasses the step S16.

Figure 13:
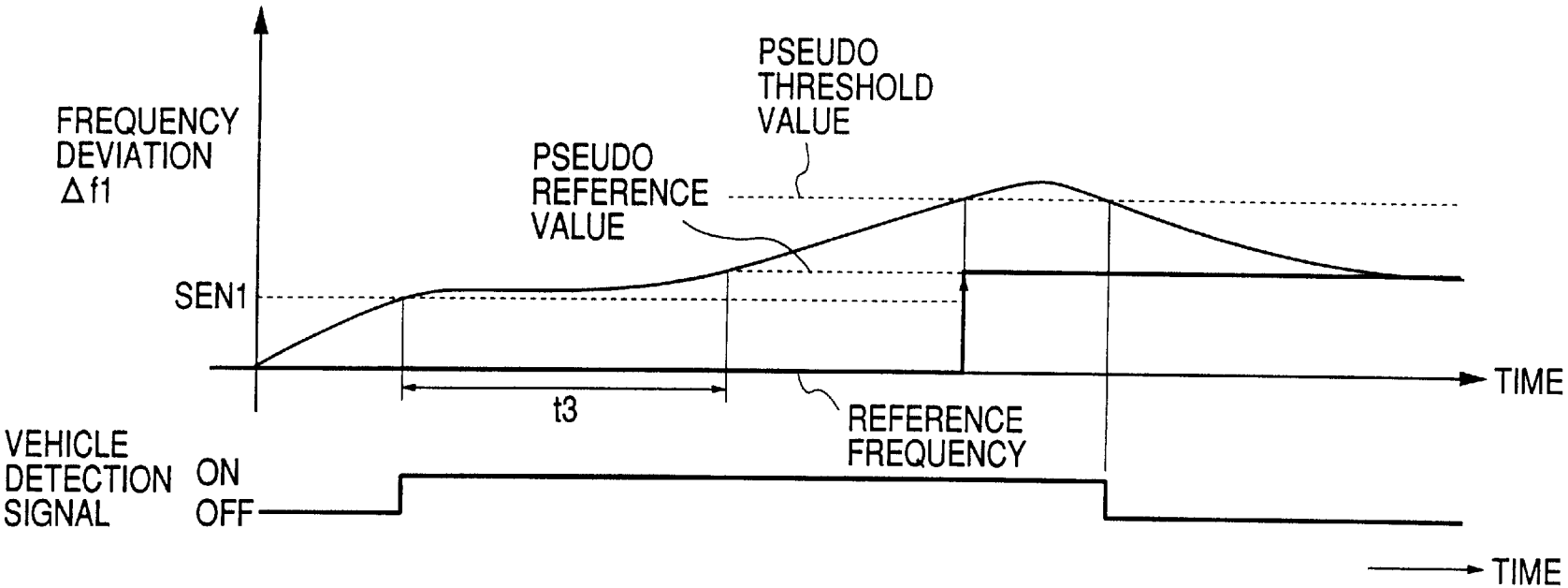
FIG. 13 is a time-domain diagram of a frequency deviation and a vehicle detection signal which occur in the vehicle sensing apparatus of FIG. 10.

FIG. 13 shows an example of conditions where the frequency deviation Δf1 remains equal to or greater than the first predetermined threshold value SEN1 for a long time. As shown in FIG. 13, when the frequency deviation Δf1 increases to the first predetermined threshold value SEN1, the vehicle detection signal is changed to a state of "1" (an on state) which represents that a vehicle passes through the given region (the sensing area) determined by the position of the loop coil 11. In the case where the lapse of time during which the frequency deviation Δf1 remains equal to or greater than the first predetermined threshold value SEN1 reaches the predetermined tracking time t3, the pseudo reference value REFs is set to the frequency deviation Δf1 while the pseudo threshold value SENs is set greater than the pseudo reference value REFs by the given value. The frequency deviation Δf1 continues to be compared with the pseudo threshold value SENs. When the frequency deviation Δf1 decreases to the pseudo threshold value SENs, the vehicle detection signal is changed to a "0" state or an off state which represents that a vehicle does not pass through the given region (the sensing area) determined by the position of the loop coil 11.

It should be noted that a first reference frequency REF1 may be corrected to correspond to or agree with the pseudo reference value REFs when the frequency deviation Δf1 increases to the pseudo threshold value SENs.

What is claimed is:

1. A method of sensing a vehicle, comprising the steps of:

placing first and second loop coils at respective positions separate from each other by a predetermined distance;

generating a first electric signal depending on an inductance of the first loop coil;

generating a second electric signal depending on an inductance of the second loop coil;

detecting a speed of a vehicle, which passes through first and second given regions determined by the respective positions of the first and second loop coils, in response to the first and second electric signals;

comparing the first electric signal with a reference signal to decide whether or not a vehicle passes through the first given region determined by the position of the first loop coil;

controlling the reference signal in response to conditions of the first electric signal which occur in a follow-up time; and changing the follow-up time in response to the detected vehicle speed.

2. A method as recited in claim 1, wherein the changing step comprises increasing the follow-up time as the detected vehicle speed decreases.

3. A method of sensing a vehicle, comprising the steps of:

placing first and second loop coils at respective positions separate from each other by a predetermined distance;

generating a first electric signal depending on an inductance of the first loop coil;

generating a second electric signal depending on an inductance of the second loop coil;

comparing the first electric signal with a reference signal to decide whether or not a vehicle passes through a given region determined by the position of the first loop coil;

controlling the reference signal in response to the first electric signal;

deciding whether or not the first and second electric signals correlate with each other;

permitting the control of the reference signal when it is decided that the first and second electric signals correlate with each other; and inhibiting the control of the reference signal when it is decided that the first and second electric signals do not correlate with each other.

4. A method of sensing a vehicle which uses a loop coil, the method comprising the steps of:

generating an electric signal depending on an inductance of the loop coil;

comparing the electric signal with a reference signal to decide whether or not the electric signal is in a range determined by the reference signal, wherein the electric signal being in the range represents that a vehicle passes through a given region determined by a position of the loop coil, and the electric signal being not in the range represents that a vehicle does not pass through the given region determined by the position of the loop coil; and changing the reference signal in cases where the electric signal continues to be in the range for a predetermined time.

5. An apparatus for sensing a vehicle, comprising:

first and second loop coils located at respective positions separate from each other by a predetermined distance;

means for generating a first electric signal depending on an inductance of the first loop coil;

means for generating a second electric signal depending on an inductance of the second loop coil;

means for detecting a speed of a vehicle, which passes through first and second given regions determined by the respective positions of the first and second loop coils, in response to the first and second electric signals;

means for comparing the first electric signal with a reference signal to decide whether or not a vehicle passes through the first given region determined by the position of the first loop coil;

means for controlling the reference signal in response to conditions of the first electric signal which occur in a follow-up time; and means for changing the follow-up time in response to the detected vehicle speed.

6. An apparatus as recited in claim 5, wherein the changing means comprises means for increasing the follow-up time as the detected vehicle speed decreases.

7. An apparatus for sensing a vehicle, comprising:

first and second loop coils located at respective positions separate from each other by a predetermined distance;

means for generating a first electric signal depending on an inductance of the first loop coil;

means for generating a second electric signal depending on an inductance of the second loop coil;

means for comparing the first electric signal with a reference signal to decide whether or not a vehicle passes through a given region determined by the position of the first loop coil;

means for controlling the reference signal in response to the first electric signal;

means for deciding whether or not the first and second electric signals correlate with each other;

means for permitting the control of the reference signal when it is decided that the first and second electric signals correlate with each other; and means for inhibiting the control of the reference signal when it is decided that the first and second electric signals do not correlate with each other.

8. An apparatus for sensing a vehicle, comprising:

a loop coil;

means for generating an electric signal depending on an inductance of the loop coil;

means for comparing the electric signal with a reference signal to decide whether or not the electric signal is in a range determined by the reference signal, wherein the electric signal being in the range represents that a vehicle passes through a given region determined by a position of the loop coil, and the electric signal being not in the range represents that a vehicle does not pass through the given region determined by the position of the loop coil; and means for changing the reference signal in cases where the electric signal continues to be in the range for a predetermined time.

9. An apparatus for sensing a vehicle, comprising:

first and second loop coils;

a first oscillation circuit including a resonance circuit, a part of which is formed by the first loop coil;

a second oscillation circuit including a resonance circuit, a part of which is formed by the second loop coil;

a first frequency counter for detecting a frequency of an output signal of the first oscillation circuit;

a second frequency counter for detecting a frequency of an output signal of the second oscillation circuit;

means for calculating a deviation of at least one of the detected frequencies from a reference frequency;

means for detecting whether or not a vehicle passes through a given region, which is determined by related one of the first and second loop coils, in response to the calculated deviation; and means for correcting the reference frequency in cases where after the calculated deviation increases to a first value, the calculated deviation remains between the first value and a second value for a follow-up time, the second value being greater than the first value.

10. An apparatus as recited in claim 9, further comprising means for detecting a speed of a vehicle, which passes through first and second given regions determined by positions of the first and second loop coils, in response to output signals of the first and second frequency counters; and means for changing the follow-up time in response to the detected vehicle speed.

11. An apparatus as recited in claim 9, further comprising means for deciding whether or not output signals of the first and second frequency counters correlate with each other; means for permitting the correction of the reference frequency when it is decided that the output signals of the first and second frequency counters correlate with each other; and means for inhibiting the correction of the reference frequency when it is decided that the output signal of the first and second frequency counters do not correlate with each other.

* * * * *